US009115659B2

(12) United States Patent
Lorenz et al.

(10) Patent No.: US 9,115,659 B2
(45) Date of Patent: Aug. 25, 2015

(54) METHOD FOR REDUCING THE PARTICLE EMISSIONS OF A SPARK-IGNITION INTERNAL COMBUSTION ENGINE WITH DIRECT INJECTION, AND INTERNAL COMBUSTION ENGINE FOR CARRYING OUT SUCH A METHOD

(71) Applicant: Ford Global Technologies, LLC, Dearborn, MI (US)

(72) Inventors: Thomas Lorenz, Cologne (DE); Moritz Klaus Springer, Hagen (DE); Helmut Hans Ruhland, Eschweiler (DE); Jan Mehring, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 541 days.

(21) Appl. No.: 13/627,953

(22) Filed: Sep. 26, 2012

(65) Prior Publication Data

US 2013/0092124 A1 Apr. 18, 2013

(30) Foreign Application Priority Data

Oct. 14, 2011 (DE) ..... 10 2011 084 545

(51) Int. Cl.

| | |
|---|---|
| ***F02D 41/30*** | (2006.01) |
| ***F02D 41/14*** | (2006.01) |
| ***F02D 41/00*** | (2006.01) |
| *F02D 3/00* | (2006.01) |
| *F02D 41/38* | (2006.01) |

(52) U.S. Cl.

CPC ..... *F02D 41/008* (2013.01); *F02D 41/1475* (2013.01); *F02D 2041/389* (2013.01)

(58) Field of Classification Search

CPC ..... F02D 41/30; F02D 41/22; F02D 41/14; F02D 41/38; F02D 3/00; F02D 41/008; F02D 2041/389; F02D 41/16; F02D 41/40; F02B 17/00

See application file for complete search history.

(56) References Cited

U.S. PATENT DOCUMENTS

| | | | | |
|---|---|---|---|---|
| 6,244,241 | B1 * | 6/2001 | Mamiya et al. | 123/295 |
| 6,340,014 | B1 * | 1/2002 | Tomita et al. | 123/295 |

FOREIGN PATENT DOCUMENTS

| | | | |
|---|---|---|---|
| DE | 19945813 | A1 | 3/2001 |
| DE | 10117519 | A1 | 10/2002 |
| DE | 10145580 | A1 | 4/2003 |
| DE | 102010003143 | A1 | 9/2011 |
| EP | 1404955 | B1 | 5/2005 |

* cited by examiner

*Primary Examiner* — Hieu T Vo

(74) *Attorney, Agent, or Firm* — Julia Voutyras; Alleman Hall McCoy Russell & Tuttle LLP

(57) ABSTRACT

A method for reducing the particle emissions of a spark-ignition, direct-injection internal combustion engine is provided. The method comprises operating at least one cylinder superstoichiometrically, responsive to an injector coking level and sufficiently high cylinder temperature, for a duration to increase oxidation of coking residues.

20 Claims, 3 Drawing Sheets

METHOD FOR REDUCING THE PARTICLE EMISSIONS OF A SPARK-IGNITION INTERNAL COMBUSTION ENGINE WITH DIRECT INJECTION, AND INTERNAL COMBUSTION ENGINE FOR CARRYING OUT SUCH A METHOD

PRIORITY CLAIM

The present application claims priority to German Patent Application Number 102011084545.3 filed on Oct. 14, 2011, the entire contents of which are hereby incorporated by reference for all purposes.

TECHNICAL FIELD

The disclosure relates to a method for reducing the particle emissions of a spark-ignition, direct-injection internal combustion engine and a spark-ignition, direct-injection internal combustion engine for carrying out such a method.

BACKGROUND AND SUMMARY

In the development of internal combustion engines, it is constantly sought to minimize fuel consumption and reduce emissions. The low fuel consumption of a direct-injection diesel engine results inter alia from the direct injection of the fuel into the combustion chamber of the at least one cylinder. The injection of fuel directly into the combustion chamber of the cylinder is therefore considered to be a suitable measure for noticeably reducing fuel consumption even in spark-ignition engines. A direct-injection, spark-ignition internal combustion engine is also the subject matter of the present disclosure.

The non-homogeneity of the fuel-air mixture is also the reason why the particle emissions from the diesel engine process are likewise of relevance in the case of the direct-injection, spark-ignition engine, whereas said emissions are of almost no significance in the case of the traditional, spark-ignition engine. In the case of the direct injection of fuel, problems are caused by the coking of the injection device.

Methods in which the fuel is introduced into the combustion chamber of the at least one cylinder by a plurality of injections duly eliminate the wetting of the combustion chamber interior wall with liquid fuel, and thus contribute to a reduction in particle emissions. Such methods, however, lead, in principle, to an increase in the total number of injections, which promotes the deposition of coking residues on the injection device. Extremely small quantities of fuel which adhere to the injection device during the injection undergo incomplete combustion under oxygen-deficient conditions.

Although said coking residues do not, necessarily, change the geometry of the injection device, nor do they adversely affect through flow characteristics and/or hinder the formation of the injection jet thereby disrupting the mixture preparation, the deposits on the injection device do lead to increased particle emissions of the internal combustion engine. Injected fuel accumulates in the porous coking residues. Often toward the end of the combustion cycle, when the oxygen has been almost completely consumed, accumulated fuel undergoes incomplete combustion and forms soot. Soot contributes to the increase in untreated particle emissions of the internal combustion engine.

Coking residues may also become detached from the injection device for example as a result of mechanical loading caused by a pressure wave propagating in the combustion chamber or the action of the injection jet. The residues detached in this way not only increase the untreated particle emissions of the internal combustion engine but may also lead to damage in the exhaust-gas discharge system, and can impair the functional capability of exhaust-gas after treatment systems provided in the exhaust-gas discharge system.

Known from the prior art are concepts which are intended to counteract the build-up of coking residues and/or which serve to deplete deposits of coking residues, that is to say to remove said coking residues from, and clean, the combustion chamber. Additionally, manual methods of cleaning the injection device by ultrasonic washing exist, but no robust method is known to clean the injection device when assembled to the engine.

The German laid-open specification DE 199 45 813 A1 describes a method for operating a direct-injection internal combustion engine in a targeted manner for cleaning the combustion chamber following detection of deposits in the combustion chamber. Measures proposed for cleaning the combustion chamber include the targeted initiation of knocking combustion and/or the introduction of a cleaning fluid into the intake combustion air. Both measures have negative implications with regard to fuel consumption and pollutant emissions.

One cleaning fluid is water. The injection of which can lower the combustion temperature and the emissions of nitrogen oxides ($NO_x$). The oxidation of soot however requires high temperatures. When using water, the coking residues are at best detached, but are not burned, resulting in an increase, rather than decrease, of the untreated particle emissions of the internal combustion engine. Furthermore, there is the risk of corrosion in the combustion chamber and in the exhaust-gas discharge system, and associated disadvantages as wear occurs.

The European patent EP 1 404 955 B1 describes an internal combustion engine whose at least one combustion chamber has, at least in regions, a catalytic coating on the surface for the purpose of oxidation of coking residues. The catalytic layer is intended to promote the oxidation of coking residues, specifically to promote fast oxidation, at typical operating temperatures, of the carbon-containing lining at a boundary surface between the catalytic converter and lining. This oxidation results in an early detachment of the deposit under the action of the prevailing flow. In this way, growth of the residues is reduced or even completely prevented. However, the minimum temperatures required for the oxidation are not always reached, even when catalytic materials are used. In particular, the required temperatures cannot always be attained at low loads and low rotational speeds. It is, however, precisely these operating conditions of the internal combustion engine, specifically low loads and/or low rotational speeds that promote the formation of coking residue deposits. Furthermore, the oxidation of the coking residues, that is to say of soot, requires not only adequately high temperatures but also oxygen or an excess of oxygen.

Another approach to adhere to future limit values for soot emissions would be for spark-ignition engines to be equipped with regenerative particle filters. However, such approaches are costly and can increase backpressure and reduce fuel economy.

The inventors herein have recognized the above issues and taken a different approach to address soot emissions of a direct injection spark-ignition gasoline engine, without reliance on a particulate filter. For example, one example method includes a method of operating a direct-injected, spark-ignited engine, comprising: direct-injecting gasoline to an engine cylinder; spark-igniting the injected gasoline; and responsive to an injector coking level and sufficiently high cylinder temperature, operating the at least one cylinder superstoichiometrically for a duration to increase oxidation of coking residues. In this way, excess oxygen is provided in the combustion process at precisely the conditions where the coking can be reduced, thus enabling reduced soot emissions while reducing the impact on three-way catalyst activity to a limited set of conditions. Specifically, because the oxidation of coking residues requires certain minimum temperatures in addition to an excess of air, the above approach only provides the lean combustion under limited conditions that are tied to the level of coking, for example. The method according to the disclosure significantly reduces the untreated particle emissions of a spark-ignition, direct-injection internal combustion engine. The untreated particle emissions may possibly be reduced to such an extent that exhaust-gas after treatment by means of a particle filter is not necessary for adhering to the legal limit values, although such a filter may be additionally used, if desired.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
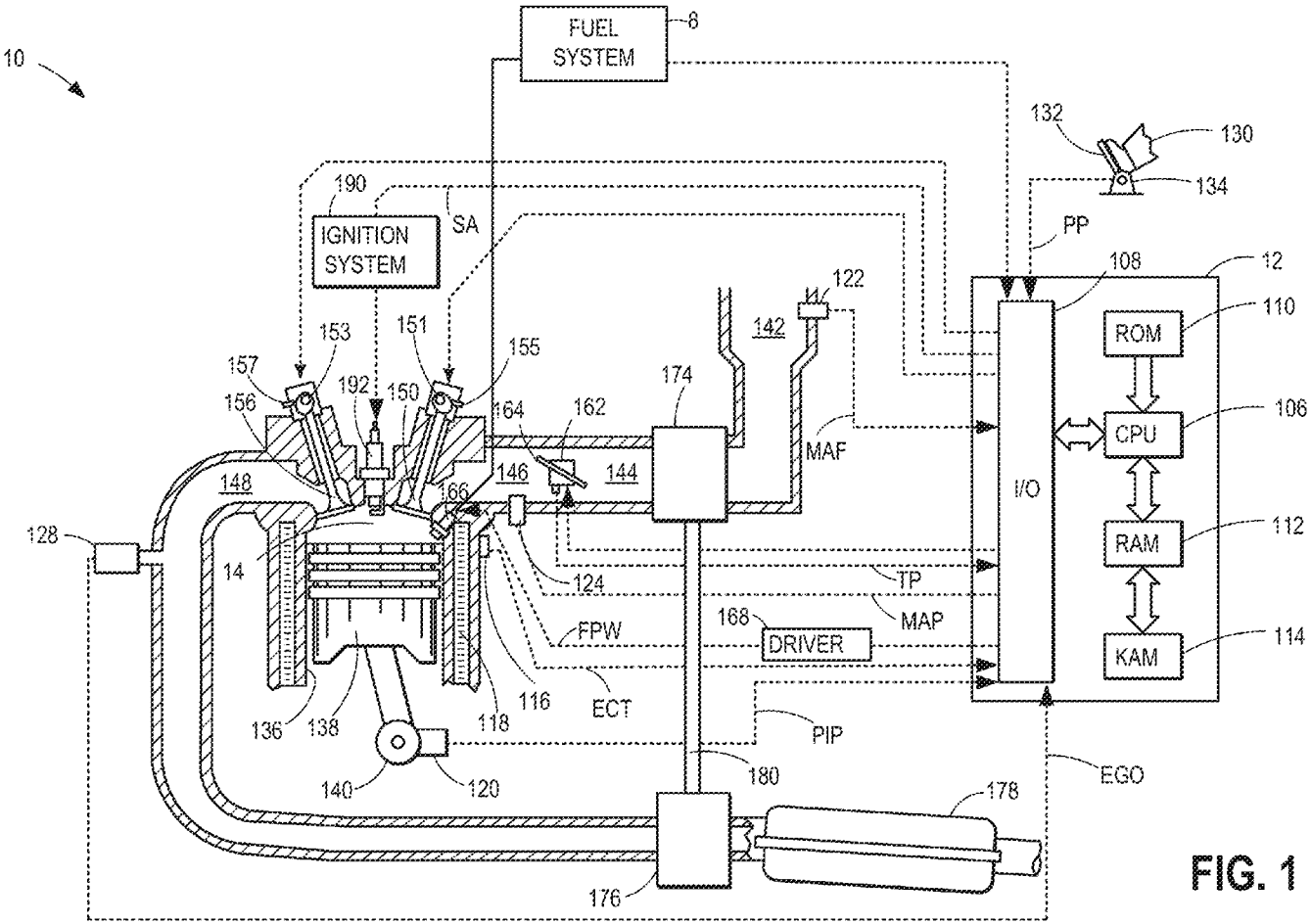
FIG. 1 shows a schematic depiction of a vehicle system including a direct-injection, spark-ignition combustion chamber and an associated emission control device.

In contrast to diesel engines, which out of principle are operated with a large excess of air ($\lambda >> 1$), spark-ignition engines are generally equipped with a three-way catalytic converter, which requires stoichiometric operation within narrow limits. According to the disclosure, a cylinder of the internal combustion engine to be cleaned is operated superstoichiometrically ($\lambda > 1$) in order to provide the oxygen required for oxidation of the coking deposits. Stoichiometric operation ($\lambda \approx 1$) of the spark-ignition engine is therefore deviated from. A deviation from the air-fuel ratio $\lambda$ required for effective exhaust-gas after treatment, with acceptance of higher pollutant emissions, is legislatively permitted only for the purpose of avoiding thermal overloading of individual components of the internal combustion engine. In the prior art, an enrichment ($\lambda < 1$) is carried out when high exhaust-gas temperatures are expected. During the course of the enrichment, more fuel is injected than can actually be burned with the provided air quantity, with the excess fuel likewise being heated and evaporated, such that the temperature of the combustion gases falls. Said approach is duly considered to be disadvantageous from energy-related aspects, in particular with regard to the fuel consumption of the internal combustion engine, and with regard to pollutant emissions, but is nevertheless recognized as being admissible and expedient for achieving the aim.

For the reasons stated above, embodiments of the method are advantageous in which the at least one cylinder is operated with an air-fuel ratio $\lambda \leq 1.15$. Particularly advantageous embodiments of the method are in which the at least one cylinder is operated with an air-fuel ratio $\lambda \leq 1.1$, preferably with an air-fuel ratio $\lambda \leq 1.05$. The two above example embodiments make allowance for the fact that a three-way catalytic converter arranged in the exhaust-gas discharge system does not require exactly stoichiometric operation ($\lambda = 1$) of the spark-ignition engine but rather merely stoichiometric operation ($\lambda \approx 1$) within narrow limits. The pollutant conversion is more effective, the closer the air-fuel ratio $\lambda$ is to stoichiometric operation. With regard to a three-way catalytic converter arranged in the exhaust-gas discharge system, it is therefore the case, in accordance with a preferred embodiment, that only slight leaning is carried out in order that the air-fuel ratio required for the conversion of the pollutants in the three-way catalytic converter is, at least approximately, ensured even during the cleaning.

During a leaning, less fuel is injected than could be burned with the provided air quantity, that is to say more air is provided than is required for the combustion of the fuel. The excess air participates in the combustion process, that is to say is concomitantly heated. At the start of the leaning, the exhaust-gas temperature may increase slightly, which is highly advantageous with regard to the cleaning of the at least one cylinder, because the oxidation of coking residues requires certain minimum temperatures in addition to an excess of air. The method according to the disclosure significantly reduces the untreated particle emissions of a spark-ignition, direct-injection internal combustion engine. The untreated particle emissions may possibly be reduced to such an extent that exhaust-gas after treatment by means of a particle filter is not necessary for adhering to the legal limit values.

Embodiments of the method are advantageous in which the air-fuel ratio $\lambda$ is increased by reducing the injected fuel quantity. The air-fuel ratio $\lambda$ could, theoretically, also be increased, that is to say, raised, by means of a greater air mass, wherein the air mass is normally varied and set by adjusting a throttle flap provided in the intake system. This would however simultaneously lead to a change in power output. To increase the air-fuel ratio $\lambda$ while maintaining the same power output, it is therefore advantageous to reduce the injected fuel quantity, which may be realized through suitable actuation of the injection device of the respective cylinder.

Embodiments of the method are advantageous in which the component temperature of the injection device of the at least one superstoichiometrically ($\lambda > 1$) operated cylinder is raised in order to assist the oxidation of coking residues for the purpose of cleaning In the above method variant, the temperature of the injection device is raised in a targeted manner by means of additional measures such that the minimum temperatures required for the oxidation of coking residues are attained even in the case of adverse boundary conditions, for example low loads and/or low rotational speeds.

In this connection, embodiments of the method are advantageous in which the component temperature of the injection device is raised by virtue of the ignition time being shifted in the early direction. An adjustment of the ignition time in the early direction, that is to say toward smaller crank angles proceeding from a working cycle which covers 720° C.A, shifts the combustion focus and the entire combustion process into the vicinity of top dead center, and/or into the compression phase. By means of this measure, the process pressures and process temperatures can be increased. The higher combustion temperatures inevitably also lead to higher component temperatures, in particular to higher temperatures of the components and walls which delimit the combustion chamber, and therefore also to a higher component temperature of the injection device. If a shift of the ignition time in the early direction is used for raising the temperature, the ignition time can be shifted in the late direction, back to the ignition time which is optimized with regard to fuel consumption, after the method according to the invention as per the variant in question has been carried out.

Embodiments of the method are also advantageous in which the component temperature of the injection device is raised by virtue of the combustion gas fraction of the cylinder fresh charge being reduced. The combustion gases may be recirculated exhaust gas and/or residual gas remaining in the cylinder. The temperature of the cylinder fresh charge generally rises if the combustion gas fraction increases. The rate of combustion at which the fuel-air mixture burns after the initiation of the ignition however simultaneously decreases with increasing combustion gas fraction. The reduced rate of combustion leads to lower process pressures and lower process temperatures. Conversely, the process temperatures can be increased by virtue of the combustion gas fraction of the cylinder fresh charge being reduced. As already described above, the higher process temperatures lead to higher component temperatures, in particular also to a higher temperature of the injection device.

For the reasons stated, in the case of internal combustion engines equipped with an exhaust-gas recirculation system, embodiments of the method are advantageous in which the component temperature of the injection device is raised by virtue of the exhaust-gas quantity recirculated by means of the exhaust-gas recirculation system being reduced. Embodiments of the method are also advantageous in which the component temperature of the injection device is raised by virtue of the residual gas quantity remaining in the at least one cylinder after a charge exchange being reduced. In the case of internal combustion engines which are equipped with an, at least partially, variable valve timing system, embodiments of the method are advantageous in which the residual gas quantity is reduced by decreasing the valve overlap.

If the internal combustion engine is equipped with a liquid-cooling arrangement, embodiments of the method are advantageous in which the component temperature of the injection device is raised by virtue of the temperature of the cooling liquid of the liquid-cooling arrangement being raised. The less heat is dissipated by means of cooling liquid, the higher are the component temperatures and therefore also the component temperature of the injection device relevant here. Furthermore, as a result of the raising of the temperature of the cooling liquid, less fuel is accumulated or deposited in the coking residues.

In the case of internal combustion engines equipped with a charge-air cooling means, embodiments of the method are advantageous in which the component temperature of the injection device is raised by virtue of the charge-air cooling means being bypassed. In the case of supercharged internal combustion engines a charge-air cooler is often provided in the intake line downstream of the compressor, by means of which charge-air cooler the compressed charge air is cooled before it enters the at least one cylinder. The cooler lowers the temperature and thereby increases the density of the charge air, such that the cooler also contributes to improved charging of the cylinders, that is to say to a greater air mass. In contrast, if it is sought to raise the component temperature of the injection device, it is advantageous, in accordance with the present method variant, for the charge-air cooling means to be bypassed.

Embodiments of the method are advantageous in which the at least one cylinder is switched to superstoichiometric operation ($\lambda>1$) for the purpose of cleaning the injection device when a predefinable amount of coking residues deposited on the injection device is detected.

In this connection, embodiments of the method are advantageous in which the amount of coking residues deposited on the injection device is estimated by means of a mathematical model, and the amount determined in this way is compared with the predefinable amount, the cleaning being initiated by virtue of the at least one cylinder being switched to superstoichiometric operation when the predefinable amount is exceeded.

Embodiments of the method are also advantageous in which the at least one cylinder is switched to superstoichiometric operation ($\lambda>1$) for the purpose of cleaning the injection device when a predefinable operating duration of the internal combustion engine is exceeded or when a vehicle in which the internal combustion engine is used has traveled a predefinable distance.

Embodiments of the method are advantageous in which, for each cylinder which is operated superstoichiometrically ($\lambda_{superstoich}>1$) for the purpose of cleaning, one cylinder of the internal combustion engine is operated substoichiometrically ($\lambda_{substoich}<1$), preferably with $\lambda_{substoich}\approx 2-\lambda_{superstoich}$. In said method variant, it is advantageous for the exhaust gas of the cylinder operated superstoichiometrically and the exhaust gas of the cylinder operated substoichiometrically to be merged upstream of the exhaust-gas after treatment systems, in particular upstream of a three-way catalytic converter provided in the exhaust-gas discharge system, such that unburned exhaust-gas components originating from the cylinder operated substoichiometrically can be oxidized with the excess oxygen from the cylinder operated superstoichiometrically, and the three-way catalytic converter is acted on with an exhaust-gas flow which is characterized by an overall air-fuel ratio $\lambda_{overall}\approx 1$.

For the same reasons, embodiments of the method are also advantageous in which the at least one cylinder which is operated superstoichiometrically ($\lambda_{superstoich}>1$) for n working cycles for the purpose of cleaning the injection device is, subsequently to the cleaning for n working cycles, operated substoichiometrically ($\lambda_{substoich}<1$), preferably with $\lambda_{substoich}\approx 2-\lambda_{superstoich}$.

In contrast to the method variant described above, in which exhaust gas from different cylinders is merged or mixed in order to produce an exhaust-gas flow with a stoichiometric air-fuel ratio, in the present case the exhaust gas from the same cylinder is used. It is assumed here that the exhaust gas from the working cycles carried out with a lack of oxygen and the exhaust gas from the working cycles carried out with an excess of oxygen mix together in the exhaust-gas discharge system, and form an exhaust-gas flow with a stoichiometric air-fuel ratio, before the exhaust gas reaches the exhaust-gas treatment systems.

In the case of internal combustion engines with an odd number of cylinders, it is out of principle not possible to realize a situation in which, for each cylinder which is operated superstoichiometrically ($\lambda_{superstoich}>1$) for the purpose of cleaning, one cylinder of the internal combustion engine is operated substoichiometrically ($\lambda_{substoich}<1$). However, if the individual cylinders are operated superstoichiometrically and substoichiometrically in an alternating fashion in a suitable way, it is possible even in the case of an odd number of cylinders to generate an overall exhaust-gas flow which is characterized by a stoichiometric air-fuel ratio $\lambda \approx 1$.

Embodiments of the method are advantageous in which the cleaning is carried out at low load and low rotational speed of the internal combustion engine. As already mentioned, it is possible with the method according to the invention for the deposits of coking residues to be counteracted even in the part-load range. Carrying out the method at low load and low rotational speed of the internal combustion engine, as per the method variant in question, is advantageous because these operating conditions of the internal combustion engine expedite the formation and deposit of coking residues. At low load and low rotational speed, therefore, the need for a method for removing said deposits is particularly great.

Embodiments of the method are advantageous in which the injection pressure with which the injection device injects fuel into the combustion chamber is increased in order to assist the cleaning by means of oxidation. It is assumed here that the fuel jet entering the combustion chamber acts on the deposits and partially detaches the deposits, wherein the action of the fuel jet increases with the injection pressure.

Embodiments of the method are advantageous in which no exhaust-gas after treatment by means of a particle filter is carried out. Said method variant has the advantage that the costs for a particle filter are eliminated, wherein the particle untreated emissions must be reduced to such an extent that the legal limit values are adhered to.

In the above embodiments the internal combustion engine injection device has, at least in regions, a catalytic coating for the oxidation of coking residues. The use of catalytic materials assists the cleaning in that the minimum temperature required for the oxidation of coking residues is lowered.

FIG. 1 depicts an example embodiment of a combustion chamber or cylinder of internal combustion engine 10. Engine 10 may receive control parameters from a control system including controller 12 and input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some embodiments, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. In still other examples, no booster may be present. A throttle 162 including a throttle plate 164 may be provided along an intake passage of the engine for varying the flow rate and/or pressure of intake air provided to the engine cylinders. For example, throttle 162 may be disposed downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Exhaust temperature may be estimated by one or more temperature sensors (not shown) located in exhaust passage 148. Alternatively, exhaust temperature may be inferred based on engine operating conditions such as speed, load, air-fuel ratio, spark retard, etc. Further, exhaust temperature may be computed by one or more exhaust gas sensors 128. It may be appreciated that the exhaust gas temperature may alternatively be estimated by any combination of temperature estimation methods listed herein.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some embodiments, each cylinder of engine 10, including cylinder 14, may include at least two intake poppet valves and at least two exhaust poppet valves located at an upper region of the cylinder.

Intake valve 150 may be controlled by controller 12 by cam actuation via cam actuation system 151. Similarly, exhaust valve 156 may be controlled by controller 12 via cam actuation system 153. Cam actuation systems 151 and 153 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 150 and exhaust valve 156 may be determined by valve position sensors 155 and 157, respectively. In alternative embodiments, the intake and/or exhaust valve may be controlled by electric valve actuation. For example, cylinder 14 may alternatively include an intake valve controlled via electric valve actuation and an exhaust valve controlled via cam actuation including CPS and/or VCT systems. In still other embodiments, the intake and exhaust valves may be controlled by a common valve actuator or actuation system, or a variable valve timing actuator or actuation system.

Each cylinder of engine 10 may include a spark plug 192 for initiating combustion. Ignition system 190 can provide an ignition spark to combustion chamber 14 via spark plug 192 in response to spark advance signal SA from controller 12, under select operating modes.

Each cylinder of engine 10 may be configured with one or more fuel injectors for providing fuel thereto. As a non-limiting example, cylinder 14 is shown including one fuel injector 166. Fuel injector 166 is shown coupled directly to cylinder 14 for injecting fuel directly therein in proportion to the pulse width of signal FPW received from controller 12 via electronic driver 168. In this manner, fuel injector 166 provides what is known as direct injection of fuel into combustion cylinder 14. While FIG. 1 shows injector 166 as a side injector, it may also be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a high pressure fuel system 8 including fuel tanks, fuel pumps, and a fuel rail. Alternatively, fuel may be delivered by a single stage fuel pump at lower pressure, in which case the timing of the direct fuel injection may be more limited during the compression stroke than if a high pressure fuel system is used. Further, while not shown, the fuel tanks may have a pressure transducer providing a signal to controller 12.

As described above, FIG. 1 shows only one cylinder of a multi-cylinder engine. As such each cylinder may similarly include its own set of intake/exhaust valves, fuel injector(s), spark plug, etc.

Fuel tanks in fuel system 8 may hold fuel with different fuel qualities, such as different fuel compositions. These differences may include different alcohol content, different octane, different heat of vaporizations, different fuel blends, and/or combinations thereof etc.

Controller 12 is shown in FIG. 1 as a microcomputer, including microprocessor unit 106, input/output ports 108, an electronic storage medium for executable programs and calibration values shown as read only memory chip 110 in this particular example, random access memory 112, keep alive memory 114, and a data bus. Storage medium read-only memory 110 can be programmed with computer readable data representing instructions executable by processor 106 for performing the methods and routines described below as well as other variants that are anticipated but not specifically listed. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; absolute manifold pressure signal (MAP) from sensor 124, cylinder AFR from EGO sensor 128, and abnormal combustion from a knock sensor and a crankshaft acceleration sensor. Engine speed signal, RPM, may be generated by controller 12 from signal PIP. Manifold pressure signal MAP from a manifold pressure sensor may be used to provide an indication of vacuum, or pressure, in the intake manifold.

Figure 2:
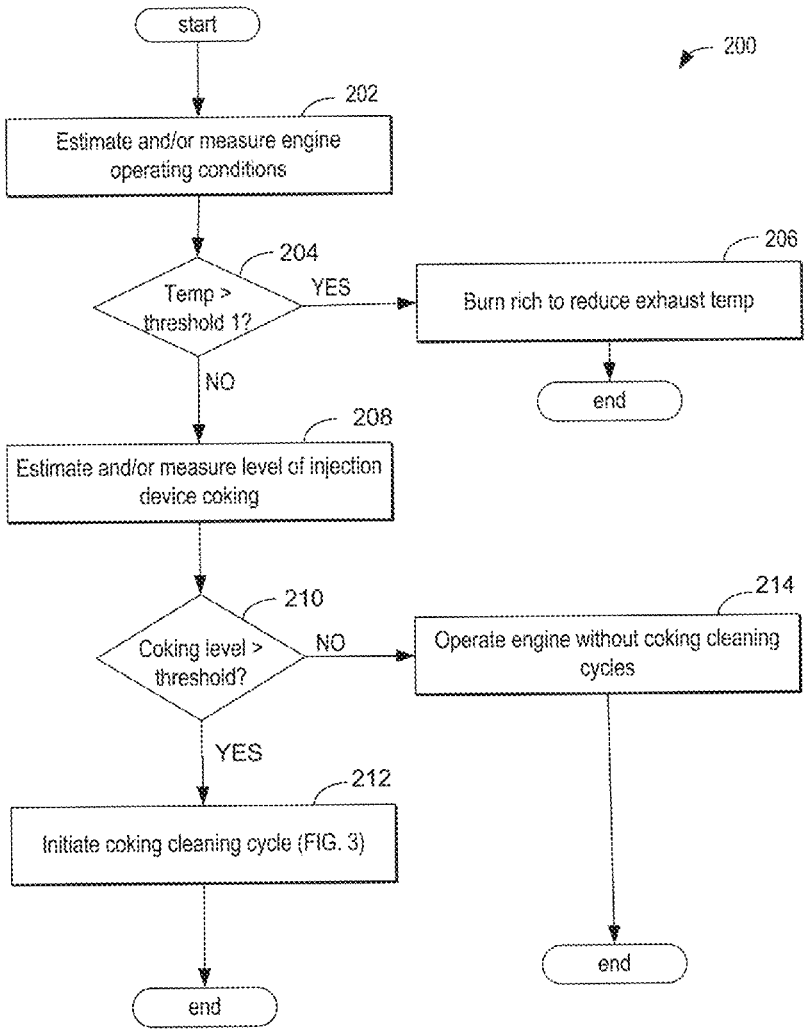
FIG. 2 shows a flow diagram illustrating the process sequence preceding initiation of an exemplary embodiment of the method according to the disclosure.

FIG. 2 shows a flowchart of an exemplary method 200 according to the disclosure. The method can be carried out by a control unit, for example controller 12 of the motor vehicle. At 202, method 200 comprises determining engine operating parameters. The operating parameters may include engine torque, engine speed, oil temperature, exhaust gas temperature and coolant temperature, throttle valve position, brake pedal position, and/or accelerator pedal position and the vehicle speed. At 204 it is determined whether the exhaust gas temperature has exceeded threshold 1, beyond which damage can be done to emission control device 178. If it is determined at 204 that the temperature has exceeded threshold 1 (YES) throttle 162 will be adjusted to allow for substoichiometric air-fuel ratio ($\lambda<1$) to reduce exhaust temperature. If, at 204, temperature threshold 1 is not exceeded (NO) coking of the injection device 166 is estimated or measured at 208. Estimates for injection device 166 coking may be based on operating conditions such as fuel speed, load, air-fuel ratio, etc. For example, an accumulating coking estimate may be provided that estimates the coking level based on operating conditions, an estimate of coking generation, and an estimate of coking regeneration.

Additionally, exhaust gas sensor 128 can monitor soot emissions from combustion chamber 14 to provide an indication of injector device 166 coking residue accumulations, by release into exhaust passage 148. If estimates of injection device coking residue accumulation do not exceed threshold at 210 (NO), no further action is required and the engine is operated without a coking cleaning cycle at 214. If threshold is exceeded at 210 (YES) a cleaning cycle to oxidize coking residues on the injection device is initiated at 212.

In this way, precautions are enacted to ensure the three-way catalyst does not experience temperatures in excess of its capacity by reducing unduly high exhaust gas temperatures resultant through superstoichiometeric operation. The coking cleaning cycle is temperature dependent, as described, however catalyst coating of the injection device allows oxidation to proceed at temperatures below those which will damage a three way catalyst. FIG. 2 describes a method in which this excessive temperature is controlled for, prior to initiation of a coking residue cleaning cycle.

Figure 3:
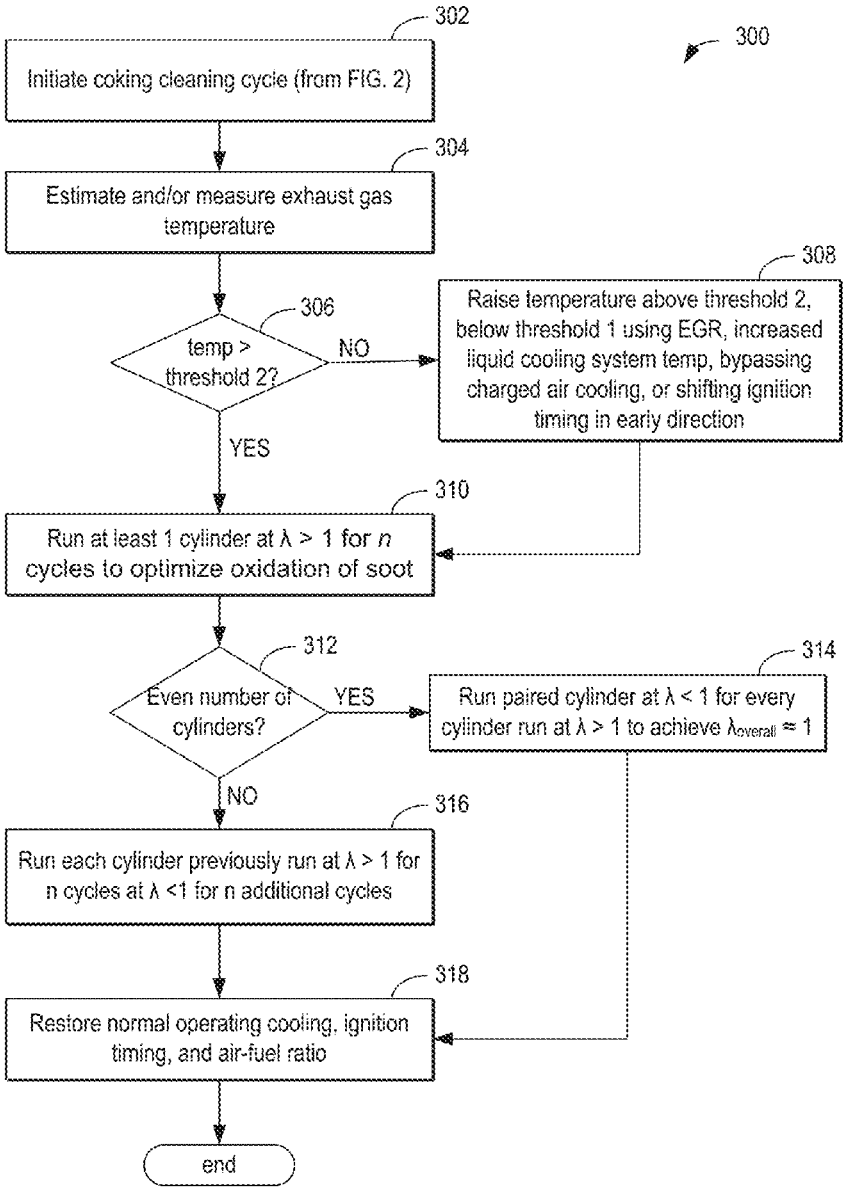
FIG. 3 shows a flow diagram illustrating the process sequence of an exemplary embodiment of the method according to the disclosure.

FIG. 3 shows a flowchart for method 300 of carrying out a cleaning cycle during engine operation to promote oxidation of coking residues on an injection device. At 302, conditions, outlined in FIG. 2, have been met to warrant initiation of a cleaning cycle to oxidize coking residues on an injection device. At 304, the temperature of the combustion chamber must be measured and/or estimated. The estimate can be based on engine operating conditions or calculated using measurements by exhaust gas sensor 128. If it is determined at 306 that the temperature within the combustion chamber is likely greater than threshold 2 (YES), optimal temperature conditions for coking residue oxidation have been met and method 300 will proceed to 310. If the temperature is not greater than threshold 2 at 306 (NO), methods as described above will be enacted at 308 to increase component temperature in the combustion chamber to a level in excess of threshold 2, but below threshold 1. These actions include the use of possible, existing exhaust gas recirculation system, liquid cooling system, or charged air cooling system, or the shifting of ignition timing in the early direction. At the desired temperature range the coking residue cleaning cycle can proceed.

Oxidation of coking residues in the presence of a catalyst may be performed at high temperature in the presence of oxygen, e.g., above a threshold temperature. To make available excess oxygen for the purpose of increasing oxidation of coking residues at least 1 cylinder of an internal combustion chamber is operated superstoichiometrically ($\lambda>1$) at 310. Measures to counterbalance effects of non stoichiometric operation are enacted dependent on the number of cylinders present. If, at 312, there is an even number of cylinders (YES), for every cylinder that is run superstoichiomterically ($\lambda>1$), a corresponding cylinder is run sub stoichiometrically ($\lambda<1$) at 314. Pairing cylinders operating at super- and sub-stoichiometric air-fuel ratio will have a net effect similar to operation at stoichiometric air-fuel ratio ($\lambda_{overall}\approx1$) which is optimal for proper functioning of emission control device 178. If, at 312, an even number of cylinders is not present (NO), a cylinder that is operated superstoichiometrically ($\lambda>1$) for n cycles, will, immediately thereafter, be operated substoichiometrically ($\lambda<1$) for an additional n cycles at 316. This pairing of super- and sub- stoichiometric cycles will mimic overall stoichiometric operation ($\lambda_{overall}\approx1$). Following super stoichiometric operation for the intent of promoting coking residue oxidation normal engine operation should be restored at 318. The method according to the disclosure then ends. As already mentioned, the method according to the disclosure can be carried out at regular intervals at predetermined time, distance, or use, or upon detection or estimation of coking residue accumulation and can be carried out as often as necessary to prevent particulate emissions due to injection device coking residue accumulation.

In one example, carrying out a coking residue cleaning cycle at a predetermined distance, subject to appropriate conditions, preemptively oxidizes coking residues as they accumulate and decreases particle emissions. Alternatively, method 300 may be enacted responsive to soot emission levels which are indicative of a coking residue accumulation. Regardless of initiating impetus, the present disclosure provides a method to oxidize coking residues on an injection device that does not impose problematic engine wear, nor require cost and labor intensive removal of the injection device. As previously stated, the present disclosure may obviate the need for additional exhaust gas after treatment by means of a particulate filter that is both costly and can increase backpressure, thus decreasing fuel economy.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method of operating a direct-injected, spark-ignited engine, comprising:

direct-injecting gasoline to an engine cylinder;

spark-igniting the injected gasoline;

responsive to an injector coking level and sufficiently high cylinder temperature, operating the at least one cylinder superstoichiometrically for a duration to increase oxidation of coking residues.

2. The method as claimed in claim 1, wherein the at least one cylinder is operated with an air-fuel ratio $\lambda \leq 1.15$ for the purpose of cleaning.

3. The method as claimed in claim 1, wherein the at least one cylinder is operated with an air-fuel ratio $\lambda \leq 1.1$ for the purpose of cleaning.

4. The method as claimed in claim 1, wherein the at least one cylinder is operated with an air-fuel ratio $\lambda \leq 1.05$ for the purpose of cleaning.

5. The method as claimed in claim 1, wherein the air-fuel ratio $\lambda$ is increased by reducing the injected fuel quantity.

6. The method as claimed in claim 5, wherein the air-fuel ratio $\lambda$ is increased with no loss of power.

7. The method as claimed in claim 1, wherein the air-fuel ratio $\lambda$ is increased proceeding from stoichiometric operation ($\lambda \approx 1$).

8. The method as claimed in claim 1, wherein the injector device is catalytically coated, at least in regions, to promote the oxidation of coking residues.

9. The method as claimed in claim 1, wherein the component temperature of the injection device of the at least one superstoichiometrically ($\lambda > 1$) operated cylinder is raised in order to assist the oxidation of coking residues for the purpose of cleaning.

10. The method as claimed in claim 9, wherein the component temperature of the injection device is raised by virtue of the ignition time being shifted in the early direction.

11. The method as claimed in claim 9, wherein the component temperature of the injection device is raised by virtue of the combustion gas fraction of the cylinder fresh charge being reduced.

12. The method as claimed in claim 9, wherein the component temperature of the injection device is raised by virtue of the temperature of the cooling liquid of the liquid-cooling arrangement being raised if the internal combustion engine is equipped with a liquid-cooling arrangement.

13. The methods as claimed in claim 9, wherein the component temperature of the injection device is raised by virtue of the exhaust-gas quantity recirculated by means of the exhaust-gas recirculation system being reduced.

14. A method of operating a direct-injected, spark-ignited engine, comprising:

direct-injecting gasoline to an engine cylinder;

spark-igniting the injected gasoline;

responsive to soot emission levels and sufficiently high cylinder temperature, operating the cylinder superstoichiometrically for a duration to promote oxidation of coking residues.

15. A method of operating a direct-injected, spark-ignited engine, comprising:

direct-injecting gasoline to an engine cylinder;

spark-igniting the injected gasoline;

during a first cylinder temperature range, operating the cylinder at a first superstoichiometric air-fuel ratio for a first duration to promote oxidation of coking residues;

and during a second cylinder temperature range higher than the first range, operating the cylinder at a second substoichiometric air-fuel ratio to reduce exhaust component overtemperature conditions.

16. The method as claimed in claim 15 wherein no exhaust-gas after treatment by means of a particle filter is carried out.

17. The method as claimed in claim 15, wherein in an engine containing an even number of cylinders for every cylinder operated superstoichiometrically another cylinder is operated substoichiometrically to achieve a net effect of approximate stoichiometric air-fuel ratio ($\lambda_{overall} \approx 1$).

18. The method as claimed in claim 17, wherein methods to compensate for a deviation from stoichiometric operation are enacted resulting in no change in efficacy of the emission control device.

19. The method as claimed in claim 15, wherein in an engine not containing an even number of cylinders for a cylinder operated superstoichiometrically for n cycles, the same cylinder is operated substoichiometrically immediately thereafter for an additional n cycles to achieve a net effect of approximate stoichiometric air-fuel ratio ($\lambda_{overall} \approx 1$).

20. The method as claimed in claim 19, wherein methods to compensate for a deviation from stoichiometric operation are enacted resulting in no change in efficacy of the emission control device.

* * * * *